US009201400B2

(12) United States Patent
Hessler et al.

(10) Patent No.: US 9,201,400 B2
(45) Date of Patent: Dec. 1, 2015

(54) FREQUENCY REGULATION OF A TIMEPIECE REGULATOR VIA ACTION ON THE RIGIDITY OF AN ELASTIC RETURN MEANS

(71) Applicant: The Swatch Group Research and Development Ltd, Marin (CH)

(72) Inventors: Thierry Hessler, St-Aubin (CH); Davide Sarchi, Renens (CH); Marc Stranczl, Nyon (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 14/620,733

(22) Filed: Feb. 12, 2015

(65) Prior Publication Data

US 2015/0234356 A1 Aug. 20, 2015

(30) Foreign Application Priority Data

Feb. 17, 2014 (EP) ..... 14155433

(51) Int. Cl.
*G04B 17/06* (2006.01)
*G04B 17/26* (2006.01)
*G04B 18/02* (2006.01)

(52) U.S. Cl.
CPC ..... *G04B 18/02* (2013.01); *G04B 17/063* (2013.01); *G04B 17/26* (2013.01)

(58) Field of Classification Search
CPC ..... G04B 17/06; G04B 17/063; G04B 17/20; G04B 17/26; G04B 17/32; G04B 18/02
USPC ..... 368/170, 175, 178, 200, 202
See application file for complete search history.

(56) References Cited

U.S. PATENT DOCUMENTS 3,451,210 A * 6/1969 Helterline, Jr et al. ..... 368/158
5,740,131 A * 4/1998 Bernasconi ..... 368/148
6,023,446 A * 2/2000 Farine et al. ..... 368/204
7,306,364 B2 * 12/2007 Born et al. ..... 368/148

(Continued)

FOREIGN PATENT DOCUMENTS

CH 615 314 1/1980
CN 103 543 631 1/2014

(Continued)

OTHER PUBLICATIONS

European Search Report issued Nov. 5, 2014 in European Application 14155433, filed on Feb. 17, 2014 ( with English Translation).

*Primary Examiner* — Vit W Miska
(74) *Attorney, Agent, or Firm* — Oblon, McClelland, Maier & Neustadt, L.L.P.

(57) ABSTRACT

Method of regulating the frequency of a resonator mechanism around its natural frequency, this mechanism including an elastic return means with a balance spring or a torsion wire, wherein a regulator device acts on this resonator mechanism with a periodic motion, with a regulation frequency which is comprised between 0.9 times and 1.1 times the value of an integer multiple between 2 and 10 of this natural frequency, controlling a periodic variation in the real part and/or the imaginary part of the rigidity of this elastic return means, this method being applied to a timepiece movement comprising a resonator mechanism of this type and including a regulator device arranged to control a periodic variation in the rigidity of this elastic return means.

41 Claims, 2 Drawing Sheets

(56) References Cited

U.S. PATENT DOCUMENTS

| | | | | |
|---|---|---|---|---|
| 8,979,359 | B2 * | 3/2015 | Rochat | 368/177 |
| 2010/0283556 | A1 | 11/2010 | Hessler et al. | |
| 2014/0286143 | A1 * | 9/2014 | Stranczl et al. | 368/178 |

FOREIGN PATENT DOCUMENTS

| | | | |
|---|---|---|---|
| DE | 1 217 883 | | 5/1966 |
| EP | 1 843 227 | A1 | 10/2007 |
| EP | 2 690 507 | A1 | 1/2014 |

* cited by examiner

FREQUENCY REGULATION OF A TIMEPIECE REGULATOR VIA ACTION ON THE RIGIDITY OF AN ELASTIC RETURN MEANS

This application claims priority from European Patent application 14155433.7 filed Feb. 17, 2014, the entire disclosure of which is hereby incorporated herein by reference.

FIELD OF THE INVENTION

The invention concerns a method of maintaining and regulating the frequency of a timepiece resonator mechanism around its natural frequency, the mechanism including at least one elastic return means that includes at least one balance spring or torsion wire or flexible guide member, where there is implemented at least one regulator device acting on said resonator mechanism with a periodic motion.

The invention also concerns a timepiece movement including at least one timepiece resonator mechanism devised to oscillate at a natural frequency, said timepiece resonator mechanism including at least one elastic return means comprising at least one balance spring or torsion wire or flexible guide member.

The invention also concerns a timepiece, more specifically a watch, including at least one such timepiece movement.

The invention concerns the field of time bases in mechanical watchmaking, in particular those based on a sprung balance resonator mechanism.

BACKGROUND OF THE INVENTION

The search for improvements in the performance of timepiece time bases is a constant preoccupation. A significant limitation on the chronometric performance of mechanical watches lies in the use of conventional impulse escapements, and no escapement solution has ever been able to avoid this type of interference.

EP Patent Application No 1843227A1 by the same Applicant discloses a coupled resonator including a first low frequency resonator, for example around a few hertz, and a second higher frequency resonator, for example around one kilohertz. The invention is characterized in that the first resonator and the second resonator include permanent mechanical coupling means, said coupling making it possible to stabilise the frequency in the event of external interference, for example in the event of shocks.

CH Patent Application No 615314A3 in the name of PATEK PHILIPPE SA discloses a movable assembly for regulating a timepiece movement, including an oscillating balance maintained mechanically by a balance spring, and a vibrating member magnetically coupled to a stationary member for synchronising the balance. The balance and the vibrating member are formed by the same single, movable, vibrating and simultaneously oscillating element. The vibration frequency of the vibrating member is an integer multiple of the oscillation frequency of the balance.

SUMMARY OF THE INVENTION

The invention proposes to manufacture a time base that is as accurate as possible.

To this end, the invention concerns a method for maintaining and regulating the frequency of a timepiece resonator mechanism around its natural frequency, the mechanism including at least one elastic return means that includes at least one balance spring or torsion wire or flexible guide member, where there is implemented at least one regulator device acting on said resonator mechanism with a periodic motion, characterized in that said periodic motion imposes a periodic modulation, with a frequency regulation which is comprised between 0.9 times and 1.1 times the value of an integer multiple of said natural frequency, said integer being greater than or equal to 2 and less than or equal to 10, by controlling a periodic variation in the real part and/or in the imaginary part of the rigidity of at least one said elastic return means.

According to a feature of the invention, said periodic motion imposes a periodic modulation of the resonant frequency of said resonator mechanism, by imposing a modulation of the cross-section of at least one said elastic return means, and/or a modulation of the modulus of elasticity of at least one said elastic return means, and/or a modulation of the shape of at least one said elastic return means, and/or a modulation of the stresses at the attachment points of at least one said elastic return means.

According to a feature of the invention, there is implemented at least one said regulator device imparting a periodic motion to at least one component of said resonator mechanism or to a tool affecting the position of such a component of said resonator mechanism and said periodic motion is imparted to a said resonator mechanism comprising at least one elastic return means comprising at least one balance spring or torsion wire or flexible guide member, and at least one said regulator device is made to act by controlling a periodic variation in the rigidity of said elastic return means by modulating the cross-section and/or modulus of elasticity and/or shape thereof and/or the stresses at its points of attachment.

The invention also concerns a timepiece movement including at least one timepiece resonator mechanism devised to oscillate at a natural frequency, said timepiece resonator mechanism including at least one elastic return means comprising at least one balance spring or torsion wire or flexible guide member, characterized in that said movement comprises at least one regulator device arranged to control a periodic variation in the rigidity of said elastic return means with a regulation frequency comprised between 0.9 times and 1.1 times the value of an integer multiple of said natural frequency of said resonator, said integer being greater than or equal to 2 and less than or equal to 10, and in that said regulator device is arranged to impart a periodic motion to at least one component of said resonator mechanism to exert on said component a twisting or traction or compression force, and/or to impart a periodic motion to at least one tool affecting the position of such a component of said resonator mechanism, and in that at least one said regulator device is arranged to impose a modulation of the cross-section of at least one said elastic return means, and/or a modulation of the modulus of elasticity of at least one said elastic return means, and/or a modulation of the shape of at least one said elastic return means, and/or a modulation of the stresses at the attachment points of at least one said elastic return means.

The invention also concerns a timepiece, more specifically a watch, including at least one such timepiece movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
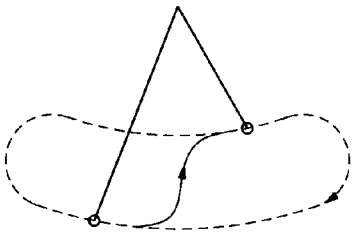
FIG. 1 shows a schematic view of a pendulum whose length is made to vary.

It is an object of the invention to produce a time base for making a mechanical timepiece, particularly a mechanical watch, as accurate as possible.

One method of achieving this consists in associating different resonators, either directly or via the escapement.

To overcome the factor of instability linked to the escapement mechanism, a parametric resonator system makes it possible to reduce the influence of the escapement and thereby render the watch more accurate.

According to the invention, a parametric oscillator utilises, for maintaining oscillations, parametric actuation which consists in varying one of the parameters of the oscillator with a regulation frequency ωR comprised between 0.9 times and 1.1 times the value of an integer multiple of the natural frequency ω0 of the oscillator system to be regulated, said integer being greater than or equal to 2, and preferably an integer multiple (particularly double) of the natural frequency ω0.

By convention and in order to differentiate clearly between them, "regulator" 2 refers here to the oscillator used for maintaining and regulating the frequency of the other maintained system, which is referred to here as "resonator" 1.

The Lagrangian L of a parametric resonator of dimension 1 is:

$$L = T - V = \frac{1}{2}I(t)\dot{x}^2 - \frac{1}{2}k(t)[x - x_0(t)]^2$$

where T is the kinetic energy and V the potential energy, and the inertia I(t), rigidity k(t) and rest position $x_0(t)$ of said resonator are a periodic function of time, x is the generalized coordinate of the resonator.

The forced and damped parametric resonator equation is obtained via the Lagrange equation for Lagrangian L by adding a forcing function f(t) and a Langevin force taking account of the dissipative mechanisms:

$$\frac{\partial^2 x}{\partial^2 t} + \gamma(t)\frac{\partial x}{\partial t} + \omega^2(t)[x - x_0(t)] = f(t)$$

where the coefficient of the first order derivative at x is:

$$\gamma(t)=[\beta(t)+\dot{I}(t)]/I(t),$$

β(t)>0 being the term describing losses, and where the coefficient of zero order term depends on the resonator frequency $\omega(t)=\sqrt{k(t)/I(t)}$.

The function f(t) takes the value 0 in the case of a non-forced oscillator.

This function f(t) may also be a periodic function, or be representative of a Dirac impulse.

The invention consists in varying, via the action of a maintenance or regulator oscillator, one or another or all of the terms β(t), ω(t), by modifying the real and/or imaginary part of the rigidity, with a regulation frequency ωR that is comprised between 0.9 times and 1.1 times the value of an integer multiple, this integer being greater than or equal to 2 (particularly double) of the natural frequency ω0 of the oscillator system to be regulated.

In a particular embodiment, the regulation frequency ωR is an integer multiple, particularly double, of the natural frequency ω0 of the resonator system to be regulated.

In a variant, the rest position $x_0(t)$ varies simultaneously with the parameters β(t), ω(t), with a regulation frequency ωR which is comprised between 0.9 times and 1.1 times the value of an integer multiple, said integer being greater than or equal to 2 (particularly double) of the natural frequency ω0 of the oscillator system to be regulated.

Preferably, all the terms β(t), ω(t), $x_0(t)$, vary with a regulation frequency ωR which is preferably an integer multiple (particularly double) of the natural frequency ω0 of the resonator system to be regulated.

Generally, in addition to modulating the parametric terms, the maintenance or regulator oscillator therefore introduces a non-parametric maintenance term f(t), whose amplitude is negligible once the parametric regime is attained [W. B. Case, The pumping of a swing from the standing position, Am. J. Phys. 64, 215 (1996)]. In a variant, the forcing term f(t) may be introduced by a second maintenance mechanism.

The parameters of this equation are the frequency term ω and the friction loss term β. The oscillator quality factor is defined by Q=ω/β.

To better understand the phenomenon, it can be likened to the example of a pendulum whose length is varied. In such case, $$\omega^2 = \frac{g}{L}$$

where L is the length of the pendulum and g the attraction of gravity.

In this particular example, if length L is modulated in time periodically with a frequency 2ω and sufficient modulation amplitude δL (δL/L>2β/ω), the system oscillates at frequency ω without damping.

[D. Rugar and P. Grutter, *Mechanical parametric amplification and thermomechanical noise squeezing*, PRL 67, 699 (1991), A. H. Nayfeh and D. T. Mook, *Nonlinear Oscillations*, Wiley-Interscience, (1977)].

The principle can be used in a timepiece or a watch which includes a mechanical sprung balance resonator, with one end of the balance spring fixed to a collet integral with the balance, and the other end fixed to a balance spring stud.

Parametric maintenance of this type of sprung balance system can be achieved notably by periodically making the balance spring stud movable.

Oscillation can be maintained and the accuracy of the system is clearly improved.

The choice of an excitation oscillator frequency which is double the frequency of the system whose oscillation regularity is required to be stabilised makes it possible to perform modulation over one complete vibration, and to obtain zero or negative damping.

Industrialization of these parametric oscillator systems is connected to the two essential functions: the supply of energy and counting.

Figure 2:
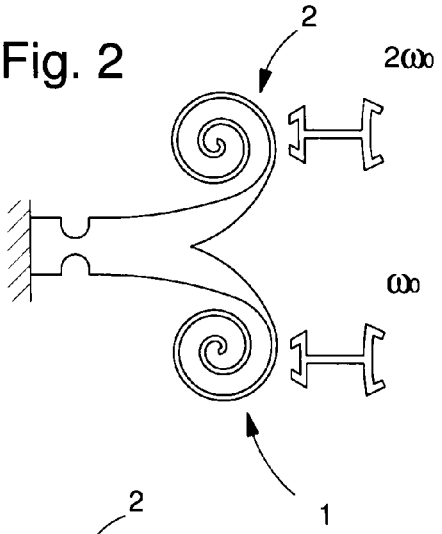
FIG. 2 shows a schematic view of a tuning fork with two sprung balances attached to each other.

These two functions may be separated, as illustrated in FIG. 2, by using a tuning fork with two sprung balances attached to each other, wherein one oscillating at a frequency $2\omega$ is linked to the escapement, and the other oscillating at a frequency $\omega$ is linked to the counting function.

It may be preferred to modify friction losses in the air rather than causing the frequency term to oscillate or to modify the inertia of the balance by means of an unbalance.

For maximum efficiency, maintenance is advantageously performed with an integer multiple frequency, notably double, of the maintained resonator frequency. The mechanical maintenance means may take various forms.

The present invention consists in varying the rigidity of the balance spring.

Excitation at double the frequency can be achieved with a square signal, or with a pulsed signal; sinusoidal excitation is not necessary.

The maintenance regulator does not need to be very accurate: any lack of accuracy results only in a loss of amplitude, but with no frequency variation (except of course if the frequency is very variable, which is to be avoided). In fact, these two oscillators, the regulator that maintains and the maintained resonator, are not coupled, but one maintains the other, in a single direction.

In a preferred embodiment, there is no coupling spring between these two oscillators.

It is quite clear that the invention differs from other known coupled oscillators: indeed, the implementation of the invention does not require reversibility of the transfer of energy between two oscillators, but rather, insofar as possible, a transfer of energy in a single direction from one oscillator to the other.

The invention more specifically concerns the frequency regulation of a timepiece resonator via action on the rigidity of an elastic return means.

Thus, the invention concerns a method of regulating the frequency of a timepiece resonator mechanism 1 around its natural frequency $\omega\mathbf{0}$. This method implements at least one regulator device 2 imparting a periodic motion to at least one component of resonator mechanism 1 or to a tool affecting the position or the rigidity of such a component of resonator mechanism 1.

This periodic motion imposes a periodic modulation of at least the resonant frequency of resonator mechanism 1, by acting on at least the rigidity of an elastic return means comprised in resonator mechanism 1 with a regulation frequency $\omega R$ which is comprised between 0.9 times and 1.1 times the value of an integer multiple of natural frequency $\omega\mathbf{0}$, this integer being greater than or equal to 2 and less than or equal to 10.

In a particular implementation of the invention, the periodic motion imposes a periodic modulation of the resonant frequency of resonator mechanism 1 by imposing both a modulation of the rigidity of resonator mechanism 1 and a modulation of the inertia resonator mechanism 1.

In a particular implementation of the invention, the periodic motion imposes a periodic modulation of the resonant frequency of resonator mechanism 1, by imposing a modulation of the cross-section of an elastic return means, particularly but not restrictively a spring, comprised in said resonator mechanism 1 and/or a modulation of the modulus of elasticity of a return means comprised in resonator mechanism 1, and/or a modulation of the shape of a return means comprised in said resonator mechanism 1.

In a particular application, this periodic motion may also require a periodic modulation of the resonant frequency of resonator mechanism 1, by also imposing a modulation of the active length of an elastic return means, particularly of a spring, comprised in resonator mechanism 1.

In a particular implementation of the invention, the periodic motion imposes a periodic modulation of the resonant frequency of resonator mechanism 1 by imposing both a modulation of the rigidity of resonator mechanism 1 and a modulation of the rest point of resonator mechanism 1.

In a particular application illustrated by the Figures, there is implemented at least one said regulator device 2 imparting a periodic motion to at least one component of resonator mechanism 1 or to a tool affecting the position of such a component of resonator mechanism 1, and this periodic motion is imparted to a resonator mechanism 1 comprising at least one elastic return means 40 comprising at least one balance spring 4 or torsion wire 46 or flexible, elastic, guide member, particularly with a virtual pivot (such as a butterfly guide member, or RCC guide member with 4 collars, a combination of flexible strips, or a set of crossed strips, or similar, made in one-piece using technologies for micromachinable materials, "MEMS", "LIGA" or similar), and at least one said regulator device 2 is made to act by controlling a periodic variation of the rigidity of elastic return means 40 by modulating its cross-section and/or modulus of elasticity and/or shape and/or the stresses at its points of attachment.

Shape modulation refers here to a deformation, under the effect of an external stress, relative to the free shape of the elastic return means, and not the normal deformation in operation that, for example, a balance spring undergoes during its contraction and elongation. It is, for example, a deformation induced by contact, by aerodynamic friction, by a contactless force such as a force of magnetic or electrostatic origin, or other means.

Naturally, the elastic return means 40 considered here is the means used to ensure the oscillation frequency of resonator mechanism 1.

The preferred application of the invention concerns watches, more specifically for an application where elastic return means 40 is formed by a torsion wire.

According to the invention, this method is applied to a resonator mechanism 1 comprising at least one elastic return means 40 including at least one balance spring 4 or torsion wire 46 or flexible guide member 46, and at least one regulator device 2 is made to act by controlling a periodic variation in the real part and/or the imaginary part of the rigidity of elastic return means 40, the real pat of the rigidity defining the frequency of resonator mechanism 1, and the imaginary part of the rigidity defining the quality factor of resonator mechanism 1.

In the variants illustrated in FIGS. 3 to 8 (where the balance is not shown to avoid overloading the Figures), this method is applied to a sprung balance assembly 3 whose balance spring 4 forms the elastic return means 40 and is held between a balance spring stud 5 at a first outer end 6 and on a collet 7 at a second inner end 8, and at least one regulator device 2 is made to act by controlling a periodic variation of the real part and/or the imaginary part of the rigidity of balance spring 4.

Figure 3:
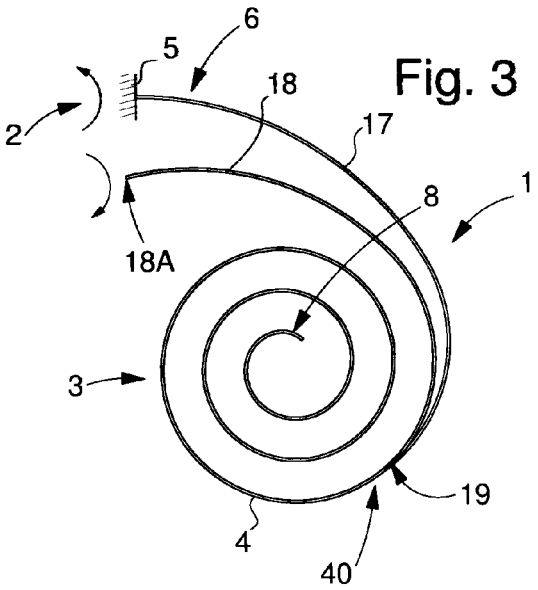
FIG. 3 shows a partial, schematic view of the balance spring of a sprung-balance assembly, with an additional coil fixed to the balance-spring and locally lining the outer terminal curve of the balance spring, and a regulator device for creating twists in opposite directions in the outer terminal curve and in this additional coil.

In the variant of FIG. 3, the outer terminal curve 17 of balance spring 4 is lined locally by an additional coil 18, fixed to balance spring 4 at at least a first attachment point 19, and twists are periodically created with regulator device 2 in opposite directions on outer terminal curve 17 and on additional coil 18 by acting on balance spring stud 5, for outer terminal curve 17, and on an end 18A opposite first attachment point 19 of additional coil 18, for additional coil 18. This double twisting has the advantage of making it possible to modify the rigidity of the balance spring without modifying its position in its plane.

Figure 4:
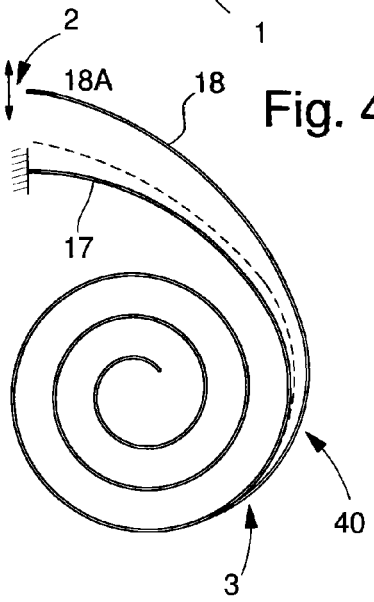
FIG. 4 shows, in a similar manner to FIG. 3, an additional coil and a regulator device actuating one end of the additional coil.

In the variant of FIG. 4, outer terminal curve 17 of balance spring 4 is locally lined by an additional coil 18, fixed to balance spring 4 at at least a first attachment point 19, and a motion is periodically created with regulator device 2 on an end 18A opposite first attachment point 19 of additional coil 18. This therefore modifies the rigidity of the outer terminal curve and consequently that of the balance spring. Regulator device 2 can also be used to move balance spring stud 5 and end 18A.

It is possible to give a specific rigidity to additional coil 18 and in particular:

either additional coil 18 is chosen to have equivalent flexibility to that of outer terminal curve 17, or additional coil 18 is chosen to be more rigid than outer terminal curve 17.

Figure 5:
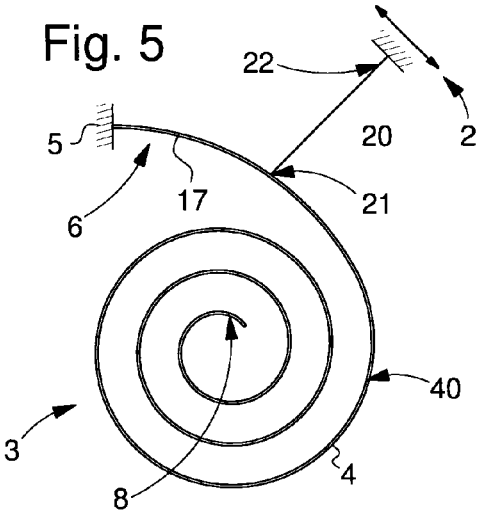
FIG. 5 shows a balance spring to which an arm is attached, and a regulator device actuating one end of the arm.

In the variant of FIG. 5, an arm 20 is fixed to outer terminal curve 17 of balance spring 4 at at least a second attachment point 21, and a motion is periodically made with regulator device 2 on one end 22 of arm 20 opposite second attachment point 21. In a particular variant, arm 20 is chosen to be more rigid than outer terminal curve 17.

Figure 6:
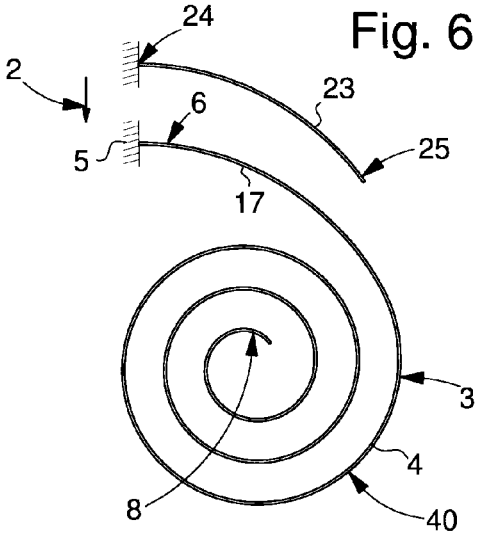
FIG. 6 illustrates a balance spring with, in proximity to its outer terminal curve, another coil which is held at a first end by a support operated by a regulator device, and which is free at a second end arranged to periodically come into contact with the outer terminal curve under the action of the regulator device on this support.

In the variant of FIG. 6, in proximity to outer terminal curve 17 of balance spring 4, there is positioned another coil 23, which, in the rest state of resonator mechanism 1, is completely independent of elastic return means 40 and remote therefrom, and which is held at a first end by a support 24 operated by regulator device 2 and which is free at a second end 25 arranged to periodically come into contact with outer terminal curve 17 under the action of regulator device 2 on support 24. This other curved coil 23 thus periodically approaches and possibly adheres to balance spring 4 to modify the rigidity of the return component.

Figure 7:
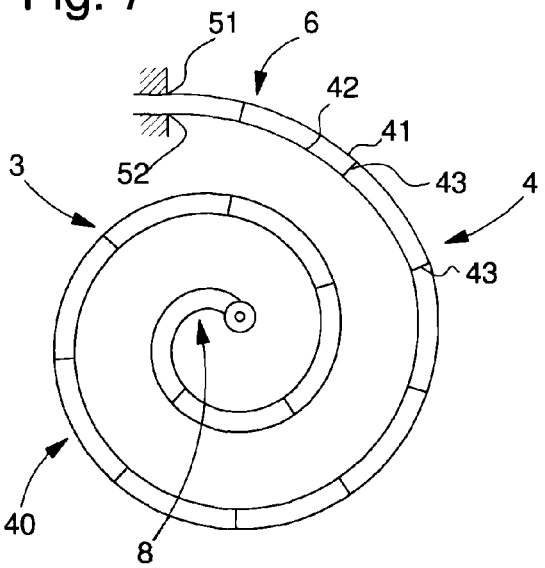
FIG. 7 illustrates a balance spring comprising two conductive strips separated by isolating elements.
Figure 7A:
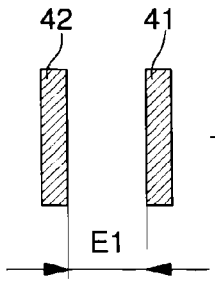
FIGS. 7A and 7B show, in cross-section, two cross-sections of the balance spring according to the electrical fields applied thereto.
Figure 7B:
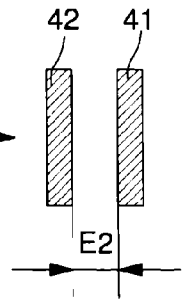

In the variant of FIG. 7, balance spring 4 is made with at least two conductive strips 41, 42, separated by isolating elements 43, and a regulator device 2 is used to periodically apply a field to the two strips 41, 42 so as to modify the distance E1 (FIG. 7A) or E2 (FIG. 7B) between these two strips 41, 42 and thereby modify the total cross-section and the rigidity of balance spring 4. In a variant, a different field is periodically applied thereto.

In particular, the two strips 41, 42 are subjected to a different electromagnetic and/or electrostatic and/or magnetostatic field by a motion imparted to a ferromagnetic or magnetised or electrostatically conductive or electrified pole piece (particularly magnets or electrets) in immediate proximity to each strip so that an electric or magnetic or electrostatic or magnetostatic force is created between them and the strips move towards or away from each other. The rigidity of balance spring 4 is modified because its cross-section varies. The motion is preferably mechanically imparted to these pole pieces.

In a variant, the two strips 41, 42 are subjected to an electrical or electrostatic field so as to locally polarize balance spring 4 and locally modify its rigidity 4.

Figure 8:
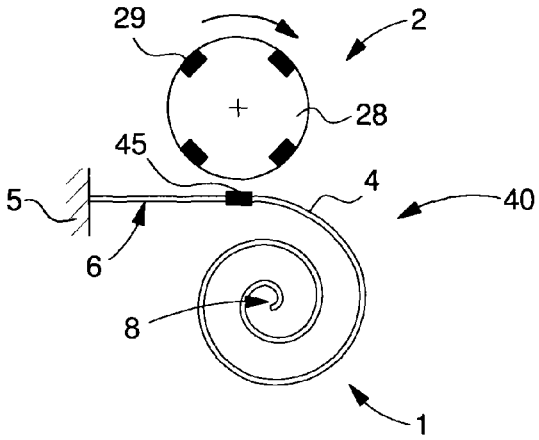
FIG. 8 illustrates a regulator device comprising a rotating wheel set provided with magnets at its periphery and whose field periodically cooperates with a magnet placed on the outer terminal curve of a balance spring.

The variant of FIG. 8 uses this type of regulator device 2, including a rotating wheel set 28 provided with magnets 29 at its periphery and whose field periodically cooperates with at least one magnet 45 placed on balance spring 4 (the magnet could be placed on the side of the collet), to periodically modify the rigidity of balance spring 4. The prestress of the balance spring and the radial position of the counting point are also periodically modified.

Another variant uses an inhomogeneously magnetised rotating wheel set 28 to periodically modify the rigidity of balance spring 4 by the phenomenon of magnetostriction.

An electrostatic variant uses this type of regulator device 2, comprising a similar rotating wheel set 28, this time provided with electrets at its periphery, and whose electric field periodically cooperates with at least one electret placed on the outer terminal curve 17 of the balance spring 4 to periodically modify the rigidity of balance spring 4 by the phenomenon of piezoelectricity.

In yet another variant, rigidity is modulated via a temperature variation.

In an advantageous implementation of this method, valid for all the variants set out above, the regulation frequency $\omega R$ is double the natural frequency $\omega 0$.

In an advantageous implementation of the method, the relative amplitude of modulation of the real part of the rigidity of resonator mechanism 1 is more than two times the inverse quality factor of resonator mechanism 1.

The invention also concerns a timepiece movement 10 including at least one timepiece resonator mechanism 1 devised to oscillate at a natural frequency $\omega 0$, this timepiece resonator mechanism 1 comprising at least one elastic return means 40 including at least one balance spring 4 or torsion wire 46 or flexible guide member. According to the invention, this movement 10 comprises at least one regulator device 2 controlling a periodic variation of the rigidity of elastic return means 40 with a regulation frequency $\omega R$, which is comprised between 0.9 times and 1.1 times the value of an integer multiple of the natural frequency $\omega 0$ of resonator 1, said integer being greater than or equal to 2 and less than or equal to 10.

In the variants illustrated in FIGS. 3 to 8, timepiece regulator mechanism 1 comprises at least one sprung balance assembly 3, whose balance spring 4 forms the elastic return means 40 and is held between balance spring stud 5 at a first outer end 6 and on a collet 7 at a second inner end 8, and regulator device 2 controls a periodic variation of the rigidity of balance spring 4.

In the variant of FIG. 3, movement 10 includes an additional coil 18 fixed to balance spring 4 at at least a first attachment point 19 and locally lining outer terminal curve 17 of balance spring 4. Regulator device 2 periodically creates twists in opposite directions on outer terminal curve 17 and on additional coil 18, by acting on balance spring stud 5 for outer terminal curve 17, and on an end 18A of additional coil 18 opposite first attachment point 19.

In the variant of FIG. 4, movement 10 includes an additional coil 18 fixed to balance spring 4 at at least a first attachment point 19 and locally lining outer terminal curve 17 of balance spring 4, and regulator device 2 periodically makes a motion on an end 18A of additional coil 18 opposite the first attachment point 19.

Additional coil 18 is either of equivalent flexibility to that of outer terminal curve 17 or much more rigid than outer terminal curve 17.

In the variant of FIG. 5, movement 10 includes an arm 20 fixed to outer terminal curve 17 of balance spring 4 at at least a second attachment point 21, and regulator device 2 periodically makes a motion on one end 22 of arm 20 opposite to second attachment point 21.

In a particular embodiment, arm 20 is more rigid than outer terminal curve 17.

In the variant of FIG. 6, movement 10 includes, in proximity to outer terminal curve 17 of balance spring 4, another coil 23 which is held at a first end by a support 24 operated by regulator device 2 and which is free at a second end 25 arranged to periodically come into contact with outer terminal curve 17 under the action of regulator device 2 on support 24.

In the variant of FIG. 7, balance spring 4 includes at least two conductive strips 41, 42, separated by isolating elements 43 and regulator device 2 is arranged to periodically subject the two strips 41, 42 to an electrical and/or magnetic field (in the broad sense of the above definition of "field"), so as to modify the distance E1, E2, between the two strips 41, 42 and thereby modify the total cross-section and the rigidity of balance spring 4. In particular, regulator 2 is arranged to periodically subject the two strips 41, 42 to a different electrical field.

In the variant of FIG. 8, regulator device 2 includes a rotating wheel set 28 provided with magnets 29 at its periphery and whose magnetic field periodically cooperates with at least one magnet 45 placed on outer terminal curve 17 of balance spring 4, to periodically modify the rigidity of balance spring 4.

Figure 9:
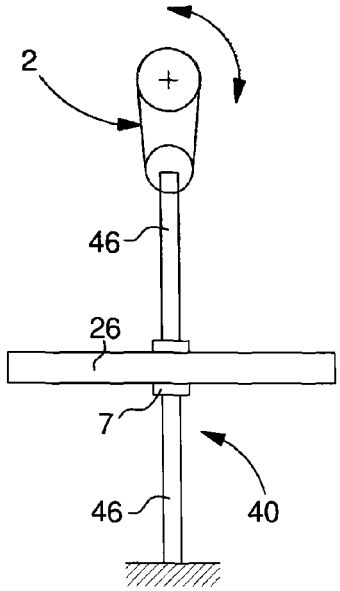
FIG. 9 illustrates a resonator mechanism comprising a balance including a collet holding a torsion wire, wherein a resonator device controls a periodic variation in tension.
Figure 10:
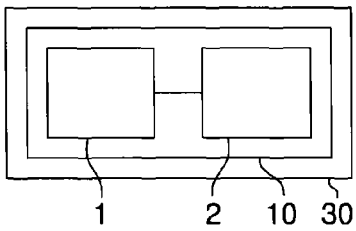
FIG. 10 shows a block diagram of a watch including a mechanical movement with a resonator mechanism regulated according to the invention.

In the variant of FIG. 9, resonator mechanism 1 includes at least one balance 26 comprising a collet 7 holding a torsion wire 46 which forms the elastic return means 40 and regulator device 2 controls a periodic variation in the tension of torsion wire 46.

In yet another variant, electrostatic layers or elements may be implemented to vary the rigidity of a spring or balance spring by partially or completely covering it with a piezoelectric layer activated by a small electronic module.

Preferably, the regulation frequency $\omega R$ of regulator device 2 is double the natural frequency $\omega 0$ of resonator mechanism 1.

The invention also concerns a timepiece, more specifically a watch 30, including at least one such timepiece movement 10.

What is claimed is:

1. A method of maintaining and regulating a frequency of a timepiece resonator mechanism about a natural frequency thereof, the mechanism including at least one elastic return means that includes at least one balance spring or torsion wire or flexible guide member, where there is implemented at least one regulator device acting on said resonator mechanism with a periodic motion, wherein said periodic motion imposes a periodic modulation, with a regulation frequency that is comprised between 0.9 times and 1.1 times a value of an integer multiple of said natural frequency, said integer being greater than or equal to 2 and less than or equal to 10, by controlling a periodic variation in a real part and/or in an imaginary part of rigidity of at least one said elastic return means.

2. The method according to claim 1, wherein said periodic motion imposes a periodic modulation of the resonant frequency of said resonator mechanism, by imposing a modulation of a cross-section of at least one said elastic return means, and/or a modulation of a modulus of elasticity of at least one said elastic return means, and/or a modulation of a shape of at least one said elastic return means, and/or a modulation of stresses at attachment points of at least one said elastic return means.

3. The method according to claim 2, wherein said periodic motion imposes a periodic modulation of the resonant frequency of said resonator mechanism, by imposing a modulation of the cross-section of at least one said elastic return means.

4. The method according to claim 2, wherein said periodic motion imposes a periodic modulation of the resonant frequency of said resonator mechanism, by imposing a modulation of the modulus of elasticity of at least one said elastic return means.

5. The method according to claim 2, wherein said periodic motion imposes a periodic modulation of the resonant frequency of said resonator mechanism, by imposing a modulation of the shape of at least one said elastic return means.

6. The method according to claim 2, wherein said periodic motion imposes a periodic modulation of the frequency of said resonator mechanism, by imposing a modulation of the stresses at the points of attachment of at least one said elastic return means.

7. The method according to claim 2, wherein said method is applied to a sprung balance assembly, whose balance spring forms said elastic return means and is held between a balance spring stud at a first outer end and on a collet at a second inner end, and in that an outer terminal curve of said balance spring is locally lined by an additional coil fixed to said balance spring at at least a first attachment point, and in that twists are periodically created with said regulator device in opposite directions on said outer terminal curve and on said additional coil, by acting on said balance spring stud, for said outer terminal curve, and on an end opposite to said first attachment point of said additional coil for said additional coil.

8. The method according to claim 7, wherein said additional coil is chosen to have equivalent flexibility to that of said outer terminal curve.

9. The method according to claim 7, wherein said additional coil is chosen to be more rigid than said outer terminal curve.

10. The method according to claim 2, wherein said method is applied to a sprung balance assembly, whose balance spring forms said elastic return means and is held between a balance spring stud at a first outer end and on a collet at a second inner end, and in that an outer terminal curve of said balance spring is locally lined by an additional coil fixed to said balance spring at least a first attachment point, and in that a motion is periodically made with said regulator device on an end opposite to said first attachment point of said additional coil.

11. The method according to claim 10, wherein said additional coil is chosen to have equivalent flexibility to that of said outer terminal curve.

12. The method according to claim 10, wherein said additional coil is chosen to be more rigid than said outer terminal curve.

13. The method according to claim 2, wherein said method is applied to a sprung balance assembly, whose balance spring forms said elastic return means and is held between a balance spring stud at a first outer end and on a collet at a second inner end, and in that an arm is fixed to an outer terminal curve of said balance spring at least a second attachment point, and in that a motion is periodically made with said regulator device on an end of said arm opposite to said second attachment point.

14. The method according to claim 13, wherein said arm is chosen to be more rigid than said outer terminal curve.

15. The method according to claim 2, wherein said method is applied to a sprung balance assembly whose balance spring forms said elastic return means and is held between a balance spring stud at a first outer end and on a collet at a second inner end, and in that, in proximity to an outer terminal curve of said balance spring, there is positioned another coil held at a first end by a support operated by said regulator device, and free at a second end arranged to periodically come into contact with said outer terminal curve under action of said regulator device on said support.

16. The method according to claim 2, wherein said method is applied to a sprung balance assembly, whose balance spring forms said elastic return means and is held between a balance spring stud at a first outer end and on a collet at a second inner end, and in that said balance spring is made with at least two conductive strips separated by isolating elements and in that said regulator device is used to periodically apply an electrical and/or magnetic field to said strips so as to modify a distance between the two said strips and thereby modify a total cross-section and rigidity of said balance spring.

17. The method according to claim 2, wherein said method is applied to a sprung balance assembly, whose balance spring forms said elastic return means and is held between a balance spring stud at a first outer end and on a collet at a second inner end, and in that said balance spring is made with at least two conductive strips separated by insulating elements and in that said regulator device is used to periodically subject said two strips to a different electrical or electrostatic field so as to locally polariser said balance spring and locally modify rigidity thereof.

18. The method according to claim 2, wherein said method is applied to a sprung balance assembly, whose balance spring forms said elastic return means and is held between a balance spring stud at a first outer end and on a collet at a second inner end, and in that there is used said regulator device comprising a rotating wheel set provided with magnets at a periphery thereof and whose field periodically cooperates with at least one magnet placed on an outer terminal curve of said balance spring, to periodically modify rigidity of said balance spring.

19. The method according to claim 2, wherein said method is applied to a sprung balance assembly, whose balance spring forms said elastic return means and is held between a balance spring stud at a first outer end and on a collet at a second inner end, and in that there is used said regulator device comprising a rotating wheel set provided with electrets at a periphery thereof and whose electrical field periodically cooperates with at least one electret placed on an outer terminal curve of said balance spring, to periodically modify rigidity of said balance spring.

20. The method according to claim 2, wherein said method is applied to a sprung balance assembly, whose balance spring forms said elastic return means and is held between a balance spring stud at a first outer end and on a collet at a second inner end, and in that there is used said regulator device comprising an inhomogeneously magnetised rotating wheel set to periodically modify rigidity of said balance spring.

21. The method according to claim 2, wherein said method is applied to a said resonator mechanism comprising at least one elastic return means including at least one torsion wire, and in that at least one said regulator device is made to act by controlling a periodic variation of the rigidity of said elastic return means by periodically modulating tension of said torsion wire.

22. The method according to claim 1, wherein at least one said regulator device is made to act to periodically apply an electrical and/or magnetic field to at least one element of at least one elastic return means to modify the rigidity thereof.

23. The method according to claim 1, wherein said periodic motion imposes a periodic modulation of the resonant frequency of said resonator mechanism by imposing both a modulation of the rigidity of an elastic return means comprised in said resonator mechanism and a modulation of inertia of an unbalance of said resonator mechanism.

24. The method according to claim 1, wherein said periodic motion imposes a periodic modulation of the resonant frequency of said resonator mechanism by imposing a modulation of rigidity of said resonator mechanism and a modulation of a rest point of said resonator mechanism.

25. The method according to claim 1, wherein said regulation frequency is double said natural frequency.

26. The method according to claim 1, wherein a relative amplitude of modulation of the real part of the rigidity of said resonator mechanism is more than two times an inverse quality factor of said resonator mechanism.

27. The method according to claim 1, wherein at least one said regulator device is made to act to periodically apply an electrical and/or magnetic field.

28. A timepiece movement including at least one timepiece resonator mechanism devised to oscillate at a natural frequency, said timepiece resonator mechanism including at least one elastic return means comprising at least one balance spring or torsion wire or flexible guide member, wherein said movement comprises at least one regulator device arranged to control a periodic variation in rigidity of said elastic return means with a regulation frequency comprised between 0.9 times and 1.1 times the value of an integer multiple of said natural frequency of said resonator, said integer being greater than or equal to 2 and less than or equal to 10, and in that said regulator device is arranged to impart a periodic motion to at least one component of said resonator mechanism to exert on said component a twisting or traction or compression force, and/or to impart a periodic motion to at least one tool affecting a position of such a component of said resonator mechanism, and in that at least one said regulator device is arranged to impose a modulation of a cross-section of at least one said elastic return means, and/or a modulation of a modulus of elasticity of at least one said elastic return means, and/or a modulation of a shape of at least one said elastic return means, and/or a modulation of stresses at attachment points of at least one said elastic return means.

29. The timepiece movement according to claim 28, wherein said timepiece resonator mechanism comprises at least one sprung balance assembly, whose balance spring forms said elastic return means and is held between a balance spring stud at a first outer end and on a collet at a second inner end, and in that said regulator device controls a periodic variation in rigidity of said balance spring, and in that said resonator mechanism comprises an additional coil fixed to said balance spring at at least a first attachment point and locally lining an outer terminal curve of said balance spring, and in that said regulator device periodically creates twists in opposite directions on said outer terminal curve and on said additional coil, by acting on said balance spring stud for said outer terminal curve, and on one end of said additional coil opposite said first attachment point.

30. The timepiece movement according to claim 29, wherein said additional coil is of equivalent flexibility to that of said outer terminal curve.

31. The timepiece movement according to claim 29, wherein said additional coil is more rigid than said outer terminal curve.

32. The timepiece movement according to claim 28, wherein said timepiece resonator mechanism comprises at least one sprung balance assembly, whose balance spring forms said elastic return means and is held between a balance spring stud at a first outer end and on a collet at a second inner end, and in that said regulator device controls a periodic variation in rigidity of said balance spring, and in that said resonator mechanism includes an additional coil fixed to said balance spring at least a first attachment point and locally lining an outer terminal curve of said balance spring, and in that said regulator device periodically makes a motion on an end of said additional coil opposite said first attachment point.

33. The timepiece movement according to claim 32, wherein said additional coil is of equivalent flexibility to that of said outer terminal curve.

34. The timepiece movement according to claim 32, wherein said additional coil is more rigid than said outer terminal curve.

35. The timepiece movement according to claim 28, wherein said timepiece resonator mechanism comprises at least one sprung balance assembly, whose balance spring forms said elastic return means and is held between a balance spring stud at a first outer end and on a collet at a second inner end, and in that said regulator device controls a periodic variation in rigidity of said balance spring, and in that said resonator mechanism includes an arm fixed to an outer terminal curve of said balance spring at at least a second attachment point, and in that said regulator device periodically makes a motion on an end of said arm opposite said second attachment point.

36. The timepiece movement according to claim 35, characterized in that said arm is more rigid than said outer terminal curve.

37. The timepiece movement according to claim 28, wherein said timepiece resonator mechanism comprises at least one sprung balance assembly, whose balance spring forms said elastic return means and is held between a balance spring stud at a first outer end and on a collet at a second inner end, and in that said regulator device controls a periodic variation in rigidity of said balance spring, and in that, in proximity to an outer terminal curve of said balance spring, said resonator mechanism includes another coil which is held at a first end by a support operated by said regulator device, and free at a second end arranged to periodically come into contact with said outer terminal curve under action of said regulator device on said support.

38. The timepiece movement according to claim 28, wherein said timepiece resonator mechanism comprises at least one sprung balance assembly, whose balance spring forms said elastic return means and is held between a balance spring stud at a first outer end and on a collet at a second inner end, and in that said regulator device controls a periodic variation in rigidity of said balance spring, and in that said balance spring includes at least two conductive strips separated by isolating elements, and in that said regulator device is arranged to periodically apply an electrical and/or magnetic field to said strips so as to modify a distance between the two said strips and thereby modify a total cross-section and the rigidity of said balance spring.

39. The timepiece movement according to claim 28, wherein said timepiece resonator mechanism comprises at least one sprung balance assembly, whose balance spring forms said elastic return means and is held between a balance spring stud at a first outer end and on a collet at a second inner end, and in that said regulator device controls a periodic variation in rigidity of said balance spring, and in that said regulator device comprises a rotating wheel set provided with magnets at a periphery thereof and whose field periodically cooperates with at least one magnet placed on an outer terminal curve of said balance spring, to periodically modify the rigidity of said balance spring.

40. The timepiece movement according to claim 28, wherein said regulation frequency of said regulator device is double said natural frequency of said resonator mechanism.

41. A timepiece including at least one timepiece movement according to claim 28, wherein the timepiece is a watch.

* * * * *